United States Patent [19]

Songzeng

[11] Patent Number: 4,989,760

[45] Date of Patent: Feb. 5, 1991

[54] SELF-FILL SIPHON PIPES

[76] Inventor: Liu Songzeng, G/F, 74-3, Southwest Region, Zhongshan University, Guangzhou, China

[21] Appl. No.: 337,091

[22] Filed: Apr. 12, 1989

[30] Foreign Application Priority Data

Apr. 14, 1988 [CN] China ..... 88204537.7
Jul. 9, 1988 [CN] China ..... 88208412.7

[51] Int. Cl.[5] ..... B67D 5/06

[52] U.S. Cl. ..... 222/204; 222/416; 137/151

[58] Field of Search ..... 222/204, 416, 332, 464; 137/146, 148, 149, 151

[56] References Cited

U.S. PATENT DOCUMENTS

| | | | |
|---|---|---|---|
| 408,918 | 8/1889 | Meyer | 137/151 |
| 442,696 | 12/1890 | Thompson | 222/416 |
| 1,567,570 | 12/1925 | Catron | 222/416 |
| 1,582,399 | 4/1926 | Helander | 137/148 |
| 1,744,738 | 1/1930 | Birnie | 137/149 |
| 1,914,690 | 6/1933 | Hunt | 222/204 |
| 2,341,129 | 2/1944 | Thompson | 137/149 |
| 4,414,997 | 11/1983 | Jacobson et al. | 137/151 |

FOREIGN PATENT DOCUMENTS

| | | | |
|---|---|---|---|
| 86203750 | 6/1986 | China . | |
| 59245 | 10/1891 | Fed. Rep. of Germany | 137/151 |
| 1085123 | 1/1955 | France | 137/146 |

*Primary Examiner*—H. Grant Skaggs
*Assistant Examiner*—Dean A. Reichard

[57] ABSTRACT

A sort of self-fill siphon pipe comprises a straight tube, a hose fitted onto the upper end of the straight tube and in communication with the straight tube, and a one-way valve fitted on the lower end of the straight tube wherein the one-way valve only allows the liquid to enter into the interior of the straight tube. In another form, there is provided inside the straight tube a tubular piston having a one-way valve slidable in the tube. The one-way valve on said tubular piston has a communication direction identical with that of the one-way valve at the lower end of the straight tube. While in use, the straight tube is inserted into the liquid and moves up and down intermittently, the liquid enters into the siphon pipe intermittently through the one-way valve and the siphon pipe is led into the siphon state to automatically suck the liquid.

13 Claims, 3 Drawing Sheets

SELF-FILL SIPHON PIPES

BACKGROUND OF THE INVENTION

The present invention relates to tools for sucking liquids based on siphon principle, particularly to siphon pipes for the use of sucking oil liquid or base liquid and acid.

In the prior art, while it is recessary to suck liquid from a container, such as to suck gasoline from an oil tank, the operator usually picks up a hose to put one end of it into the gasoline in the oil tank, then has his mouth onto the other end of it to suck out part of the gasoline, resulting in a siphon state of the hose (siphon pipe). This is very inconvenient in operation, very unsanitary, and very harmful to the operator's health. Hence, in recent years, many improved siphon tools were provided, such as "the car-borne oiler" disclosed in Chinese patent No. 86203750. Though these improved siphon tools are rather effective, their structures are complicated and their costs are high.

SUMMARY OF THE INVENTION

The object of the present invention is to provide a siphon pipe which has simple structure and is safe and easy to operate.

Another object of the present invention is to provide a self-fill siphon pipe for increasing the liquid inertia, particularly adaptable for liquids of higher viscosity and smaller specific weight.

Still another object of the present invention is to provide a self-fill siphon pipe capable of filtering away the floating particles in the liquids.

Other objects and advantages of the present invention will become apparent in the following description and the appended claims.

According to the present invention, there is provided herewith a siphon tool for sucking liquid comprising a straight tube, a hose fitted onto one end of the straight tube and in fluid communication with the straight tube, a one-way valve fixed on the other end of the straight tube, which allows only the liquid to enter into the interior of the straight tube.

According to another aspect of the present invention, there is provided a siphon tool comprising a straight tube, a hose fixed onto one end of the straight tube, a one-way valve fixed on the other end of the straight tube, which allows only the liquid to enter into the interior of the straight tube, and additionally a tubular piston with a one-way valve slidable in the straight tube, said one-way valve on said tubular piston has a same communication direction as that of the one-way valve on the end of the straight tube.

On the siphon tool of the present invention, preferably a detachable filter means is fitted on the liquid entering and of the one-way valve on the end of the straight tube.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DESCRIPTIONS OF THE PREFERRED EMBODIMENT

Figures 1, 2:
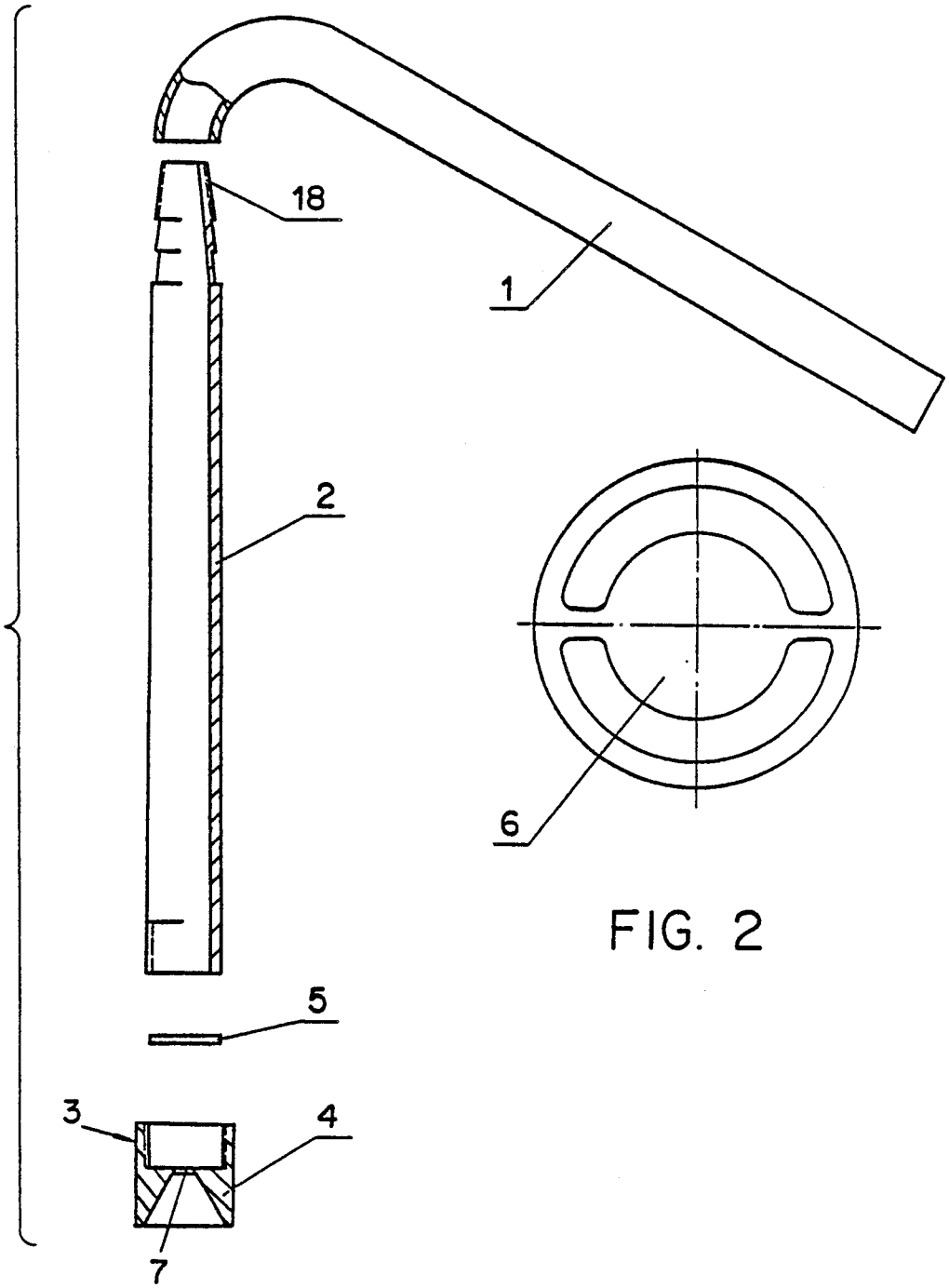
FIG. 1 is a diagrammatic exploded view of one embodiment of the siphon pipe according to the present invention.
FIG. 2 is an enlarged view of the one-way valve pad in FIG. 1.

FIG. 1 shows a self-fill siphon pipe according to the present invention which comprises: a hose 1, a straight tube 2 and a one-way valve 3. One end of the straight tube 2 has a hose joint 18 which is connected and fitted onto the hose 1. The one-way valve 3 is constituted by a valve base 4 and a valve pad 5.

FIG. 2 is an enlarged view of the valve pad 5. At the center portion of the valve pad is a central diaphragm 6. When the valve pad 5 is fitted into the valve base 4, the central diaphragm exactly covers the central hole 7 of the valve base, acting on the control of the direction of the liquid flow. Inside the valve base, there is screw thread matching with the external screw thread at the lower end of the straight tube 2 so as to fix the one-way valve onto the lower end of the straight tube 2. After it is well fixed, the one-way valve 3 allows the liquid to only flow into the interior of the straight tube from the exterior.

For the use of the siphons pipe in the present invention, it suffices to insert the one-way valve end of the straight tube into the liquid as deep as possible and then to move said tube backwards and forwards (up and down) in the direction in parallel with the axis of the straight tube so as to push open the valve pad of the one-way valve to let liquid enter the pipe by its own inertia. When the liquid having entered the pipe reaches a required volume, the siphon pipe comes into a normal siphon state.

The different parts of the siphon pipe according to the present invention, such as the straight tube 2 and the one-way valve 3 are preferably made of plastics. The length of the straight tube is preferably 5~10 cm longer than the depth of the container for the liquid so as to operate more conveniently. The inner diameter of the straight tube 2 is preferably larger than the inner diameter of the hose 1 so as to raise the speed of filling the liquid.

Figure 3:
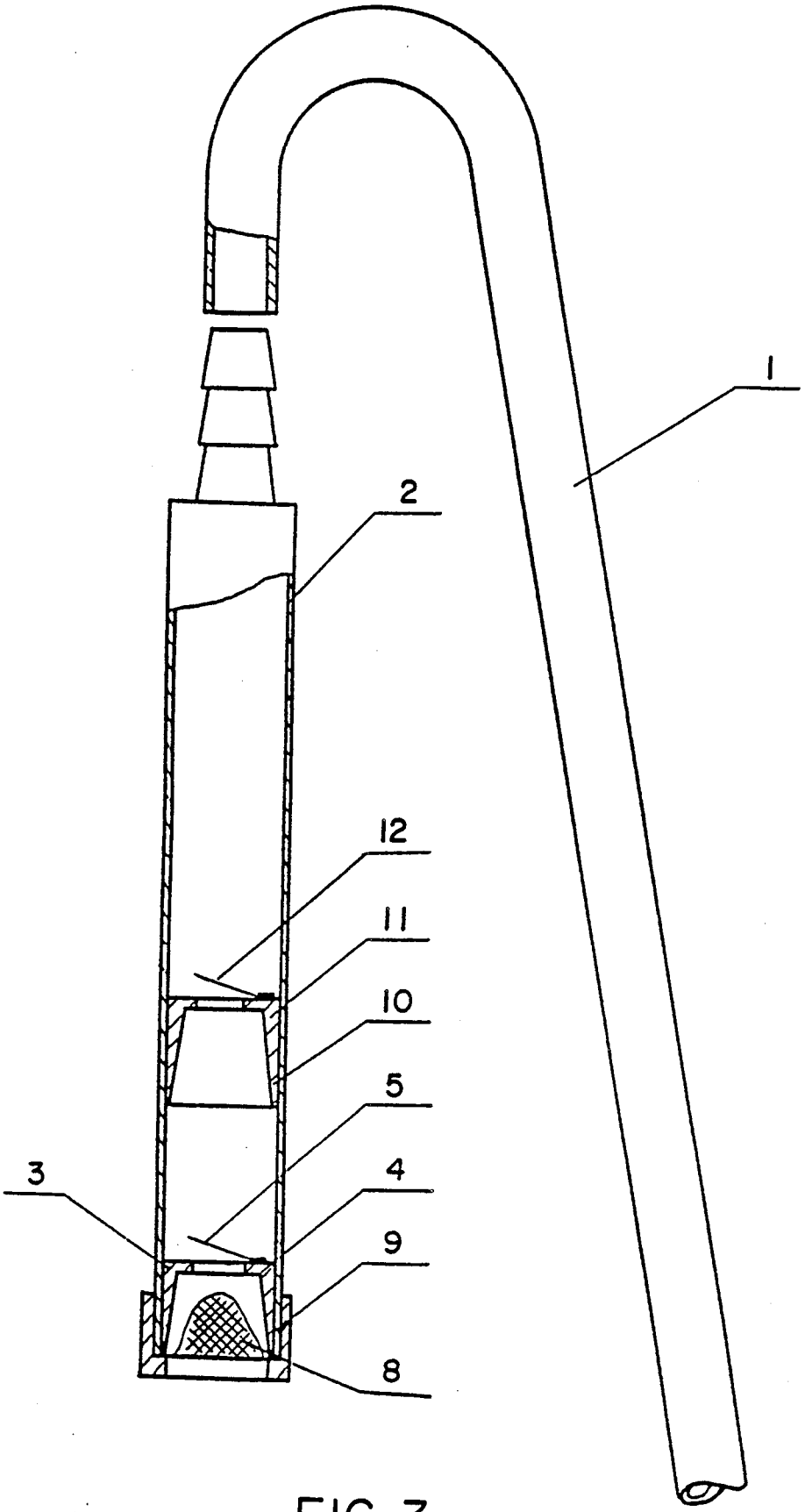
FIG. 3 is a view of the siphon pipe of another embodiment of the present invention.

The one-way valve of the siphon tube in the present invention can also take other forms such as a one-way valve 3 as shown in FIG. 3. It is also constituted by the valve base 4 and the valve pad 5, but it is inserted and fixed into the end joint of the straight tube 2. At the liquid-entering end of said one-way valve 3, a mesh filter 8 is set to filter away the floating particles in the liquid. The mesh filter 8 can be in the shape of a bowl and be fixed onto the liquid-entering end of the one-way valve 8.

This kind of siphon pipe as described above will lead to a small drop of the liquid filling efficiency when used for liquids of heigher viscosity and smaller specific weight. Because of this, another embodiment according to the present invention provides a fast and easy siphon pipe as shown in FIG. 3. This kind of siphon pipe has a structure similar to the one shown in the embodiment in FIG. 1, but a tubular piston 10 with an one-way valve is set inside the straight tube. The tubular piston 10 is capable of freely sliding within said straight tube 2. The tubular piston 10 is also constituted by a valve-base 11 and a valve pad 12. The outer diameter of said valve-base has a sliding fit with the inner diameter of the straight tube 2. Said tubular piston 10 is made of material having a larger density whose specific weight is larger than 1. The materials which can be selected for use are metal, ceramics, glass or other composite materials. In the preferred embodiment according to the present invention, the tubular piston used is ceramic meterial with a specific weight 1·2 ~ 1·4, and its merit lies in its application to sucking base liquid and acid, etc.

For the use of the siphon pipe shown as in FIG. 3, it is only necessary to insert one end of the straight tube having a one-way bottom valve 3 into the liquid and then to move up and down. While the straight tube moves down, the liquid pushes open the one-way valve 3 to enter into the siphon pipe. While the straight pipe moves upwards, the one-way bottom valve 3 closes to let the liquid stay in the pipe and the tubular piston 10 moves downwards due to its own inertia to result in the liquid below the tubular piston 10 pushing open the valve pad 12 and entering into the portion above the tubular piston 10. While the straight tube 2 moves downwards, once more the tubular piston 10 moves upwards due to its inertia resulting in a negative pressure in the straight tube portion below the tubular piston 10 and again a part of the liquid being sucked into the pipe. So on and so forth in this way, the operator moves the straight tube 2 up and down intermittently, the liquid level in the siphon pipe will continuously rise. When the liquid level in the pipe reaches a certain height, the hose is bent downwards and a siphon phenomenon will be created.

Figure 4C:
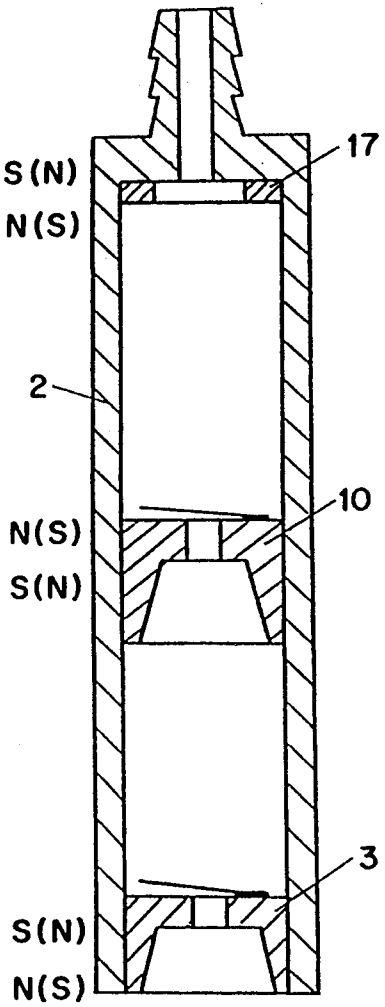
FIGS. 4*a*–4*b* show embodiments with buffer means according to the present invention.
Figure 4B:
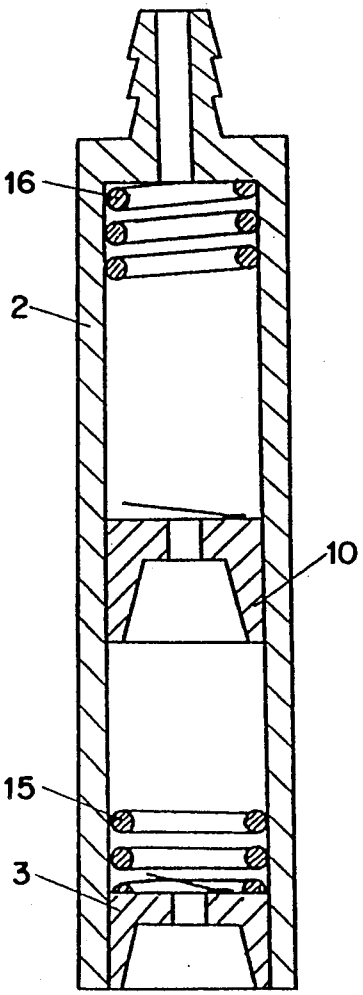
Figure 4A:
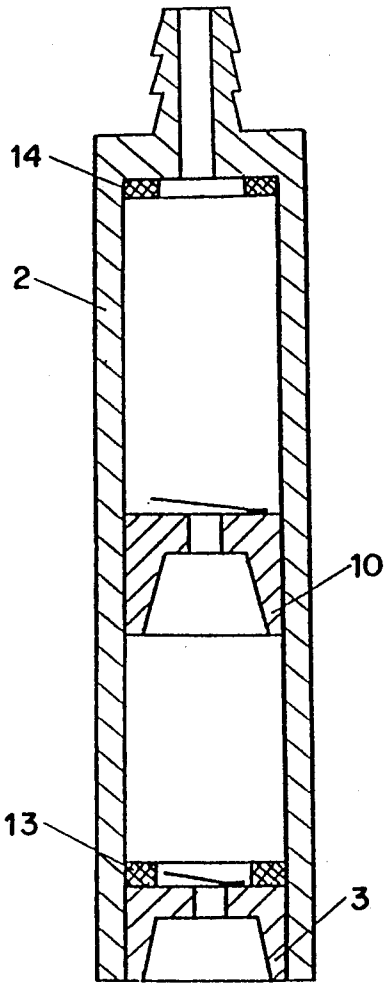

Because there is a looser sliding fit between the tubular piston 10 and the straight tube 2, the tubular piston 10 will move fast relative to the straight tube 2 and possibly collide with the one-way valve 3 at the lower end portion and the upper end wall of the straight tube 2, as the siphon pipe rapidly moves up and down in operation. In this case, especially when the tubular piston is made of ceramic material, such collision will produce adverse effects such as piston cracking. Because of this, the present invention provides a further improvement, i.e., buffer means is provided between the tubular piston 10 and the one-way valve 3 as well as between the tubular piston 10 and the upper end wall of the straight tube 2, as shown as FIG. 4. The first form of the buffer means is shown in FIG. 4*a*. In it, a rubber ring 13 is set on the upper surface of the one-way valve 3 and another rubber ring 14 is set on the upper end wall of the straight tube 2. FIG. 4*b* shows a structure similar to that of FIG. 4*a*, but springs 15 and 16 are used to replace the rubber rings 13 and 14. The outer diameters of the rubber rings 13 and 14 or the springs 12 and 16 are substantially the same as the inner diameters of the straight tube 2. The inner diameters of the rubber rings or springs should be larger than the valve pads 5 and 12 of the two one-way valves 3 and 10. As a matter of course, the rubber rings or the springs as shown in FIG. 4*a* or FIG. 4*b* can also be attached to the upper and the lower surfaces of the tubular piston 10. FIG. 4*c* shows another form of the buffer means whose one-way valve 3 and tubular piston 10 are both made of magnetic material and in which a ring 17 made of magnetic material is set at the upper end wall in the straight tube 2. Their magnetic poles are disposed so that the magnetic polarities between each two neighboring faces are identical, e.g., while the upper end of the one-way valve 3 appears to be a South pole, the lower end of the tubular piston 10 also appears to be a South pole and while the upper end face of the tubular piston 10 appears to be a North pole, the lower end of the magnetic ring 17 also appears to be a North pole; and Vice Versa. In this way, according to the principle of repelling between two like poles, while the tubular piston 10 moves close to the one-way valve 3 or the magnetic ring 17, its speed will naturally slow down under the action of the repelling force which plays a buffer role.

The siphon pipe of the present invention has a simpler structure and a lower cost; it can be easily operated and its very portable.

The content as shown in the above specification and attached drawing is only for description use. It can be seen, although the present invention has been described with reference to specific apparatus components and arrangements thereof, it will nontheless be understood that still other embodiments will become apparent which are within the spirit and scope of the present invention defined in the following claims.

I claim:

1. A siphon tool used for sucking liquids comprising;
a straight tube;
a hose fitted onto an upper end of said straight tube and in communication with said straight tube;
a one-way valve fitted into a lower end of said straight tube, wherein said one-way valve only allows the liquid to enter into the interior of the straight tube upon reciprocation of the straight tube; and
a tubular piston positioned in said straight tube freely slidable between said lower end and said upper end of said straight tube in response to liquids moving through said straight tube.

2. The siphon tool according to claim 1, wherein said straight tube has a larger inner diameter than that of said hose.

3. The siphon tool according to claim 1, wherein means for filtering fluid are fitted onto a liquid-entering end of said one-way valve.

4. The siphon tool according to claim 1, wherein the tubular piston is provided with a one-way valve, said one-way valve of said tubular piston has a communication direction identical with that of the one-way valve fitted onto the lower end of the straight tube.

5. The siphon tool according to claim 4 wherein said tubular piston is made of metal.

6. The siphon tool according to claim 4, wherein said tubular piston is made of ceramic material.

7. The siphon tool according to claim 4, wherein buffer means is provided for buffering movement of said tubular piston when said tubular piston approaches the one-way valve located at the lower end of the straight tube as well as when the tubular piston approaches an upper end wall of the straight tube.

8. The siphon tool according to claim 7, wherein said buffer means comprises a rubber ring fitted onto the one-way valve at the lower end of straight tube.

9. The siphon tool according to claim 7, wherein said buffer means, comprises a spring fitted onto the one-way valve at the lower end of the straight tube and a spring at the upper end wall of the straight tube.

10. The siphon tool according to claim 7, wherein said buffer means comprises the one-way valve at the lower end of the straight tube the tubular piston slidable in the straight tube and a ring located at the upper end of the straight tube all being made of a magnetic material, with their magnetic poles disposed so that neighboring faces of the one-way valve and the tubular piston have identical polarity therebetween and neighboring faces of the tubular piston and magnetic ring at the upper end of the straight tube have identical polarity therebetween.

11. The siphon tool according to claim 4, wherein said straight tube has an inner diameter larger than that of said hose.

12. The siphon tool according to claim 4, wherein means for filtering fluid are fitted onto a liquid-entering end of said one-way valve located at the lower end of the straight tube.

13. A method for siphoning liquids comprising the steps of:

providing a siphon tool having a hollow, straight tube with a longitudinal axis, a bendable hose fitted onto an upper end of said straight tube and a one-way valve fitted onto a lower end of said straight tube;

providing a tubular piston within the straight tube, said tubular piston having a one-way valve;

inserting the lower end of said straight tube into a body of liquid to be siphoned;

opening said one-way valve of the straight tube as said straight tube is inserted into the body of liquid to admit liquid into the interior of the straight tube;

immersing said straight tube into said body of liquid by lowering the straight tube generally along the longitudinal axis thereof;

moving said tubular piston toward the upper end of the straight tube as liquid is admitted;

removing said straight tube from said body of liquid by raising the straight tube generally along the longitudinal axis thereof;

closing the one-way valve as said straight tube is removed from the body of liquid to thereby prevent liquid admitted to the straight tube from exiting through the lower end thereof;

reciprocating said straight tube along the longitudinal axis by repeatedly immersing and removing the straight tube from the body of liquid until a predetermined liquid level is reached within the siphon tool;

moving said tubular piston toward the lower end of said straight tube when the one-way valve in the straight tube is closed;

opening the one-way valve in the tubular piston when said tubular piston moves toward the lower end of the straight tube;

closing the one-way valve in the tubular piston when said tubular piston moves toward the upper end of the straight tube;

creating a negative pressure in the straight tube below the tubular piston when the tubular piston moves toward the upper end thereof and when the straight tube is being immersed to thereby suck liquid into the siphon tool; and bending the hose downwardly after the liquid reaches the predetermined liquid level to thereby create a siphon effect.

* * * * *